US006440091B1

(12) United States Patent
Hirosawa

(10) Patent No.: US 6,440,091 B1
(45) Date of Patent: Aug. 27, 2002

(54) COMPACT MASSAGE MACHINE

(75) Inventor: Toshio Hirosawa, Kawagoe (JP)

(73) Assignee: Matoba Electric Manufacturing Co., Ltd., Kawagoe (JP)

( * ) Notice: Subject to any disclaimer, the term of this patent is extended or adjusted under 35 U.S.C. 154(b) by 0 days.

(21) Appl. No.: 09/552,704

(22) Filed: Apr. 19, 2000

(30) Foreign Application Priority Data

Sep. 17, 1999 (JP) ..... 11-264138

(51) Int. Cl.[7] ..... A61H 7/00
(52) U.S. Cl. ..... 601/133; 601/93; 601/95
(58) Field of Search ..... 601/133, 97, 101, 601/103, 119, 120, 125, 126, 112–116, 99, 102, 93–95

(56) References Cited

U.S. PATENT DOCUMENTS 2,232,493 A * 2/1941 Stuckey et al. ..... 15/22
3,374,784 A * 3/1968 Brent et al. ..... 128/61
3,633,571 A * 1/1972 Shinagawa et al. ..... 128/44
4,505,267 A * 3/1985 Inada ..... 128/49
5,445,595 A * 8/1995 Chou ..... 601/118
5,803,916 A * 9/1998 Kuznets et al. ..... 601/112
5,843,006 A * 12/1998 Phillips et al. ..... 601/103
6,190,339 B1 * 2/2001 Imazaike et al. ..... 601/133
6,200,282 B1 * 3/2001 Furuie et al. ..... 601/98
6,213,962 B1 * 4/2001 Shiminzu ..... 601/90

FOREIGN PATENT DOCUMENTS

JP 8-289913 * 11/1996 ..... A61H/7/00

* cited by examiner

*Primary Examiner*—Justine R. Yu
(74) *Attorney, Agent, or Firm*—Intellectual Property Solutions, P.L.L.C.

(57) ABSTRACT

A compact massage machine is provided. The massage machine comprises a rotation axle, a pair of kneading rollers, a pair of installation mechanisms, and a slide-guide mechanism. The kenading rollers are disposed on the rotation axle in an oblique fashion. The installation mechanisms, disposed on the rotation axle, install the kneading rollers on the rotation axle in a manner that the kneading rollers swing in a circumference direction of the installation mechanisms during the rotation of the rotation axle. The slide-guide mechanism, engaging with the kneading rollers, prevents the kneading rollers from rotating during the rotation of the rotation axle.

3 Claims, 6 Drawing Sheets

COMPACT MASSAGE MACHINE

BACKGROUND OF THE INVENTION

1. Field of the Invention

The present invention relates to the structure of a massage machine, which performs massage operation through a pair of kneading rollers disposed obliquely on a rotation axle of the massage machine. The kneading rollers are conducted to shake by way of rotating movement of the rotation axle, and the gap between the kneading rollers broadens and narrows cyclically during the shaking of the kneading rollers.

2. Description of the Prior Art

An operation of kneading rollers is disclosed in conventional massage machines, which enables the gap between one pair of kneading rollers to be broadened and narrowed cyclically during the shaking movement of the kneading rollers, wherein an example of such massage machines is disclosed in Japanese Utility Model Registration No. 2539695 (1997).

In the above-mentioned massage machine, one pair of kneading rollers are disposed on the rotation axle in an oblique fashion. The oblique kneading roller pair is disposed in a left-right symmetry with a gap existing therebetween and are driven to shake and rotate around the axis of the rotation axle during the rotating movement of the rotation axle. The gap between the oblique kneading rollers broadens and narrows cyclically during the shaking of the inclined kneading rollers. If a foot is placed into the aforementioned gap during operation, then a massage action, namely pushing and kneading the sole of the foot, can be attained.

Nonetheless, the kneading rollers in the above-mentioned conventional massage machine are substantially in the shape of a circular disk such that each of the kneading rollers is installed on the rotation axle by engaging to the central axis of the corresponding circular disk. Therefore, the outwardly extended margin of each of the kneading rollers on the sides performing massage operation is projecting outwardly by an amount equal to that on the opposite side where massage operation is not performed. Namely, the kneading rollers are installed in a manner symmetric to the rotation axle. For the above reason, a large space is required to allow the kneading rollers to rotate around the rotation axle. Therefore, it is quite difficult to reduce the size of a conventional massage machine.

SUMMARY OF THE INVENTION

To solve the above problem, the object of the present invention is to provide a massage machine capable of reducing the space required by the rotating movement of the kneading rollers so as to obtain a compact massage machine.

To achieve the above-mentioned object, the first characteristic of the massage machine according to this invention resides in that it performs massage operation through one pair of kneading rollers disposed obliquely on the rotation axle of the massage machine. The kneading rollers are conducted to shake through rotating movement of the rotation axle, and the gap between the kneading rollers broadens and narrows cyclically during shaking operation of the kneading rollers. The massage machine comprises one pair of kneading rollers installed on the rotation axle in a manner eccentric to the rotation axle and with the massage-actuating sides of the kneading rollers being protruding outwardly; an installation mechanism for installing the kneading rollers on the rotation axle in a manner capable of rotating around the rotation axle freely in substantial circumference direction only; and slide-guiding mechanisms installed on the non-massage-actuating sides of the kneading rollers, for allowing sliding of the kneading rollers and for preventing rotating of the kneading rollers.

According to the second characteristic of this invention, each of the slide-guiding mechanism comprises a circumferential portion having a guide groove integrally formed with the non-massage-actuating side of each kneading roller; and a side guide disposed parallel to the longitudinal axis of the rotation axle being engaged with the matching guide groove.

According to the third characteristic of this invention, the installation mechanism comprises outer retainers disposed along outer circumferential surface of the rotation axle, a matching inner retainers disposed along the inner circumference surface of each of the kneading rollers, and steel balls retained by and between the outer retainer and the inner retainer.

DETAILED DESCRIPTION OF THE INVENTION

The embodiments will be described in detail with reference made to the accompanying drawings.

Figure 2:
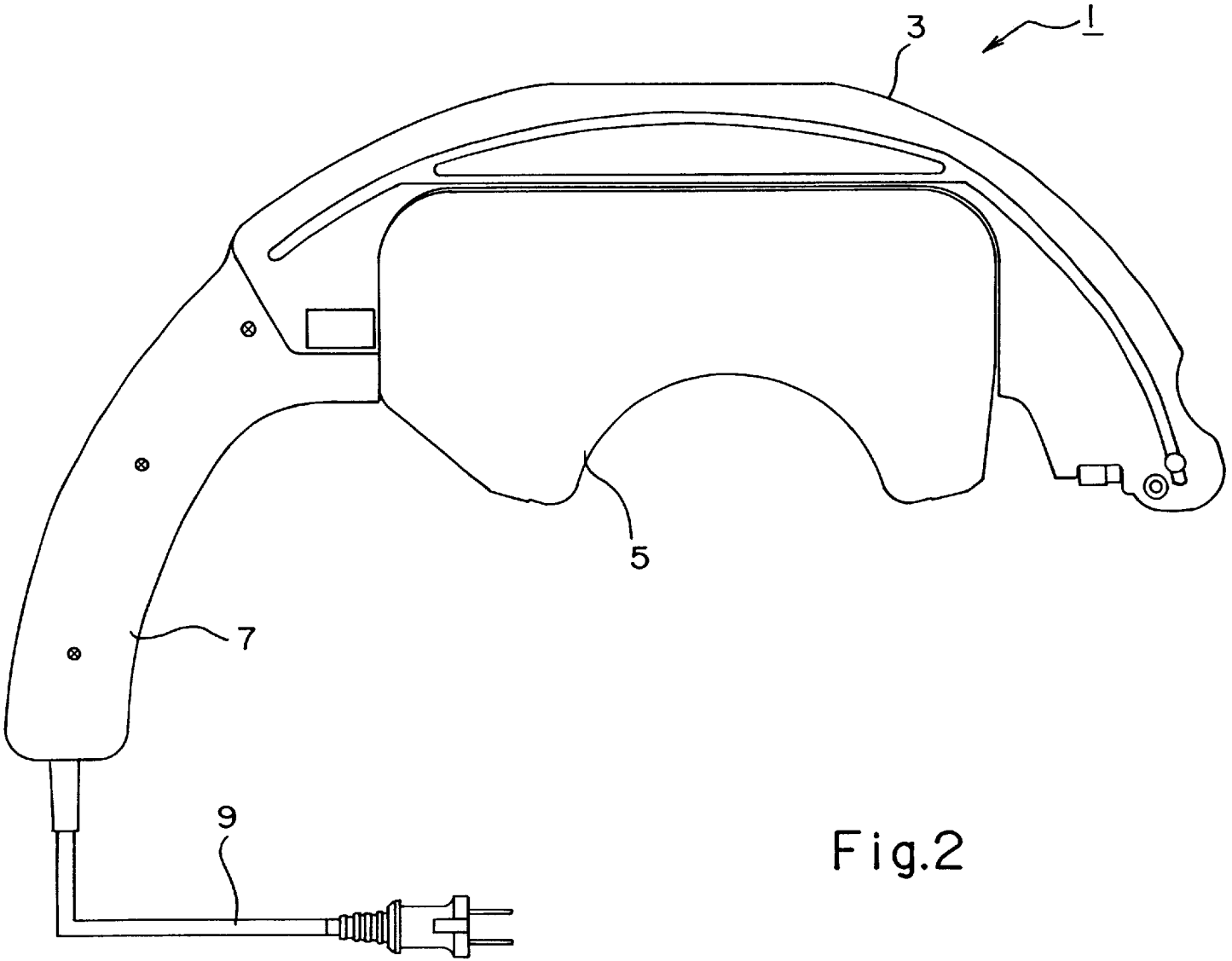
FIG. 2 illustrates the outer appearance of the massage machine shown in FIG. 1.

As shown in FIG. 2, the housing 3 of the massage machine 1 according to the present invention is substantially in the shape of a crescent, and a mechanism for performing massage operation is installed on the inner side of a circular-shaped central portion of the housing 3. A massage-actuating mechanism is sheltered by a cover 5 made of a flexible textile. A handle 7 is disposed at the left portion of the massage machine 1 shown in FIG. 2, and an electric power supply cord 9 is affixed to the handle 7.

Figure 1:
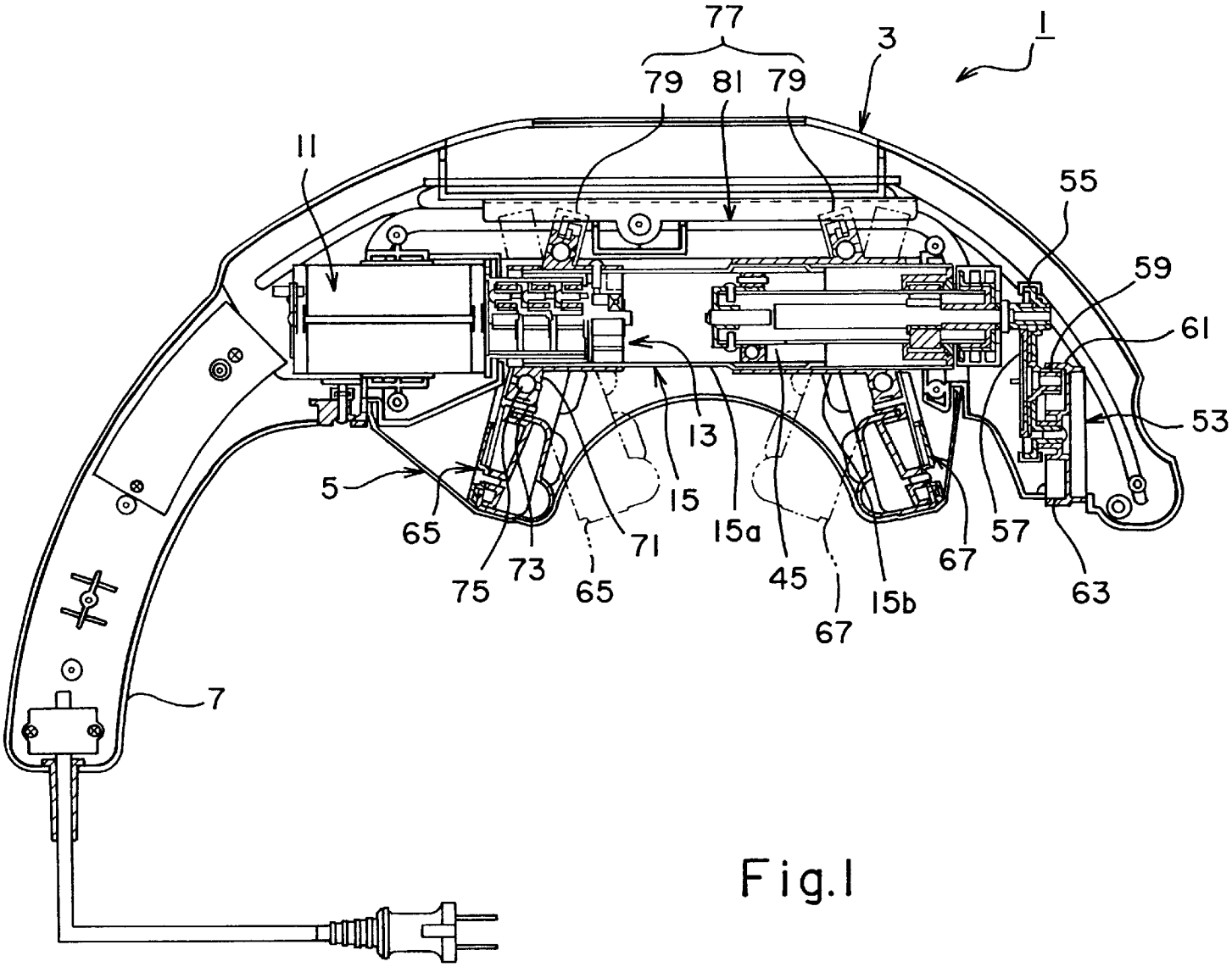
FIG. 1 is a cross-sectional view showing the whole structure of the massage machine according to an embodiment of the present invention.
Figure 1A:
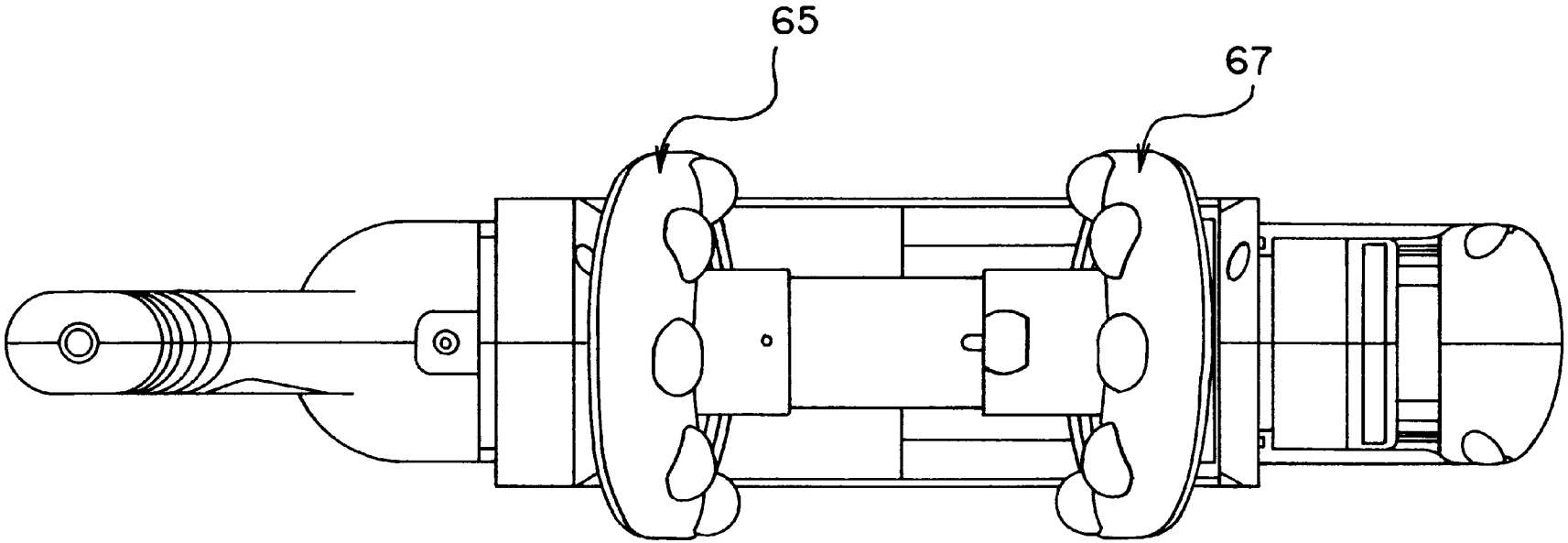
FIG. 1*a* is a front view of the bottom-side of the massage machine shown in FIG. 1.

FIG. 1 is a cross-sectional view of the massage machine shown in FIG. 2. As shown in FIG. 1, a three-stage planetary gear mechanism 13 functioning as a reduction mechanism is coupled with a motor 11 connecting to the electric power supply cord 9. The three-stage planetary gear mechanism 13 is disposed within the perimeter of an axle pipe 15, which functions as an axle.

Figure 3:
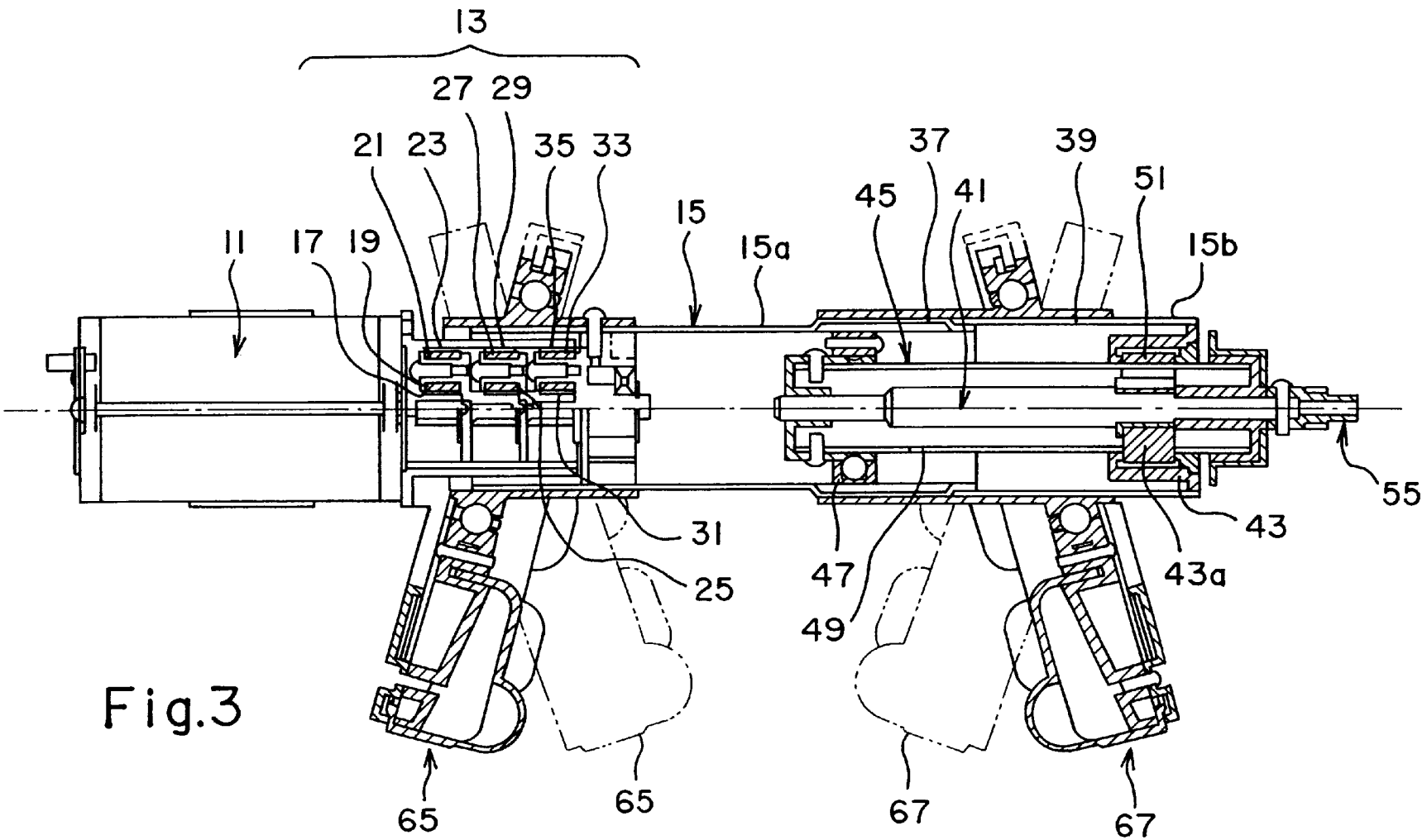
FIG. 3 depicts an important massage-actuating mechanism of the massage machine shown in FIG. 2.

As shown in FIG. 3, in the three-stage planetary gear mechanism 13, a first planet gear 21 orbits a first sun gear 19. The first sun gear 19 is coupled with the output axis 17 of the motor 11, and a first link gear 23 is affixed to the periphery of the first planet gear 21. Also, a second planet gear 27 orbits a second sun gear 25, which is coupled with the first planet gear 21, and a second link gear 29 is affixed to the periphery of the second planet gear 27. In addition, a third planet gear 33 orbits a third sun gear 31, which is coupled with the second planet gear 27, and a third link gear 35 is affixed to the periphery of the third planet gear 33.

Furthermore, the axle pipe 15 is coupled with the third planet gear 33, which is now the output portion of the three-stage planetary gear mechanism 13. The axle pipe 15 is of a structure capable of extending and shrinking without any restraint. Therefore, two pipes (namely, an inner pipe 15*a* and an outer pipe 15*b*) are fitted together in a coaxial manner. In the above-described structure, the inner pipe 15*a* and the outer pipe 15*b* can slide relative to each other in the longitudinal direction without any restraint and are mutually engaged in the rotation direction. The mutual engagement between the inner pipe 15*a* and the outer pipe 15*b* is accomplished by ribs 37 and grooves 39. The ribs 37 are formed on the outer peripheral wall of the inner pipe 15*a* and extending in the longitudinal direction of the inner pipe 15*a*. The grooves 39 are formed on the inner peripheral wall of the outer pipe 15*b* and extending in the longitudinal direction of the outer pipe 15*b*.

A threaded rod 41 is disposed within the axle pipe 15 in a coaxial manner. A feed nut 43 is engaged with a male screw formed on the outer periphery of the threaded rod 41. The feed nut 43 is engaged with the outer pipe 15*b*.

Namely, the left-side portion of a rotation cylinder 45 being coaxial and integral with the threaded rod 41 is installed within the inner pipe 15*a* by way of a bearing 47. By this arrangement, the rotation cylinder 45 is capable of rotating with respect to the inner pipe 15*a* without restraint. Furthermore, the right-side portion of the rotation cylinder 45 is capable of rotating with respect to the housing 3. An engaging portion 43*a* of the feed nut 43, which is engaged with the threaded rod 41, is protruding outward through a slit 49 formed in the rotation cylinder 45 and extending along its longitudinal axis. The engaging portion 43*a* is situated in a ring-shaped recess 51 formed by the inner peripheral wall of the outer pipe 15*b* (see FIG. 3), and the engaging portion 43*a* is constricted to move in the axial direction.

As shown in FIG. 1, the right end portion of the threaded rod 41 is coupled to a manually operated gear mechanism. Namely, a first manually operated gear 55 of small diameter is installed at the right end portion of the threaded rod 41, and a second manually operated gear 57 of relatively larger diameter is engaging with the first manually operated gear 55. Furthermore, a third manually operated gear 59 of small diameter is coaxial with the second manually operated gear 57 while a fourth manually operated gear 61 of larger diameter is engaging with the third manually operated gear 59. The fourth manually operated gear 61 is extending outside the housing 3 of the massage machine 1 through a window 63 formed in the housing 3. By this arrangement, the extending portion of the fourth manually operated gear 61 can be manually rotated.

As shown in FIGS. 1 and 3, a pair of kneading rollers 65, 67 are each installed at the inner pipe 15*a* and the outer pipe 15*b* that construct the axle pipe 15, respectively. Each of the kneading rollers 65, 67 is installed onto the axle pipe 15 in an oblique fashion and allowed to move substantially only in the circumference direction of the rotation axle without any restraint.

Figure 4B:
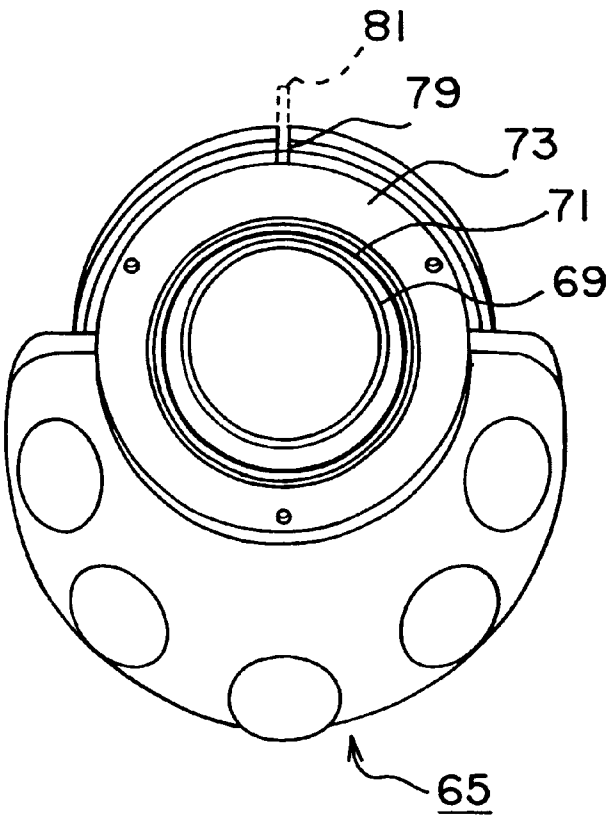
FIG. 4*b* shows a front view of the right-side kneading roller shown in FIG. 3.
Figure 4A:
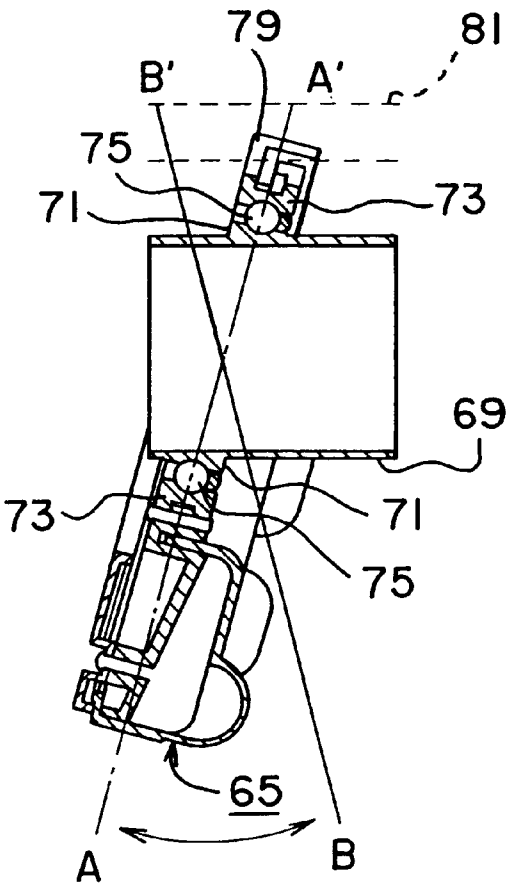
FIG. 4*a* shows a cross-sectional view of the right-side kneading roller shown in FIG. 3.
Figure 5B:
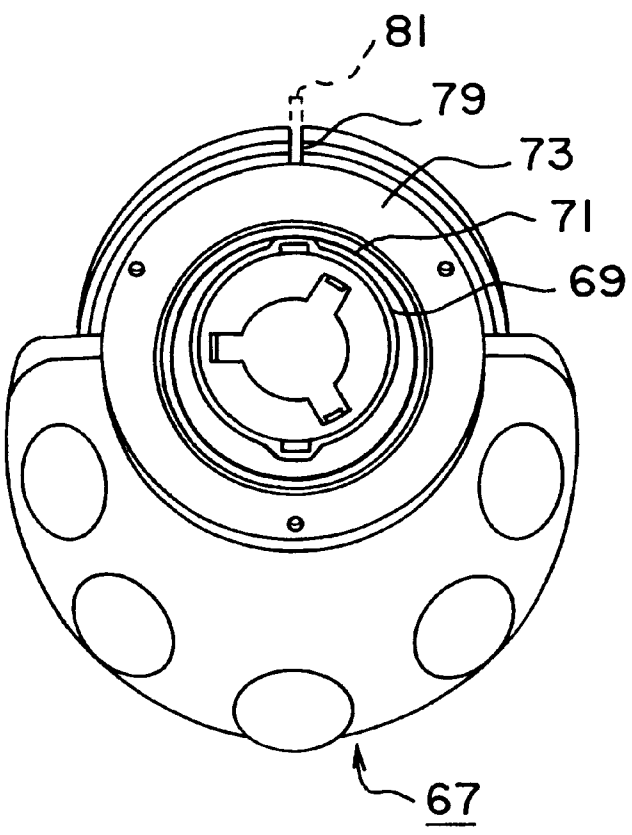
FIG. 5*b* is a front view of the left-side kneading roller shown in FIG. 3.
Figure 5A:
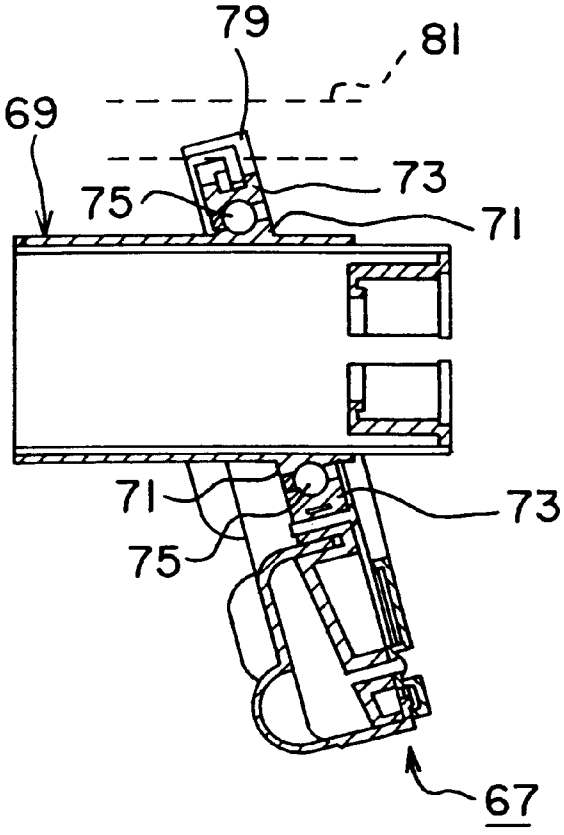
FIG. 5*a* is a cross-sectional view of the left-side kneading roller shown in FIG. 3.

An installation mechanism is shown in FIGS. 4 and 5. In the installation mechanism, an installation sleeve 69 can be installed to fit both the inner pipe 15*a* and the outer pipe 15*b*, and two outer retainers 71 are each integrally formed along the outer peripheral surface of the respective installation sleeve 69. Furthermore, an inner retainers 73 is formed along the inner peripheral surface of each of the kneading rollers 65, 67. In addition, a plurality of steel balls 75 are retained in between the outer retainer 71 and the inner retainer 73. The oblique angles of the kneading rollers 65, 67, which are each determined by the tilt formed by the respective installation sleeve 69 and inner retainers 73, are in left-right symmetry to a line perpendicular to the axle pipe 15.

Furthermore, each of the kneading rollers 65, 67 is installed in a manner eccentric to the axle pipe 15. By this arrangement, the massage-actuating sides (namely, the lower portion) of the kneading rollers 65, 67 protrudes downwardly. As shown in FIG. 1, a slide-guiding mechanism 77 is installed on the non-massage-actuating side (namely, the upper portion) of each of the kneading rollers 65, 67. The slide-guiding mechanism 77 is used for preventing rotating movement of the kneading rollers 65, 67 and simultaneously allowing sliding movement of the kneading rollers 65, 67 during shaking movement of the kneading rollers 65, 67.

Namely, in the slide-guiding mechanism 77, a plate-shaped slide guide 81 is inserting into a guide grooves 79 formed in the circular portion of the non-massage-actuating side of each of the kneading rollers 65, 67. The slide guides 81 are each affixed to the housing 3 and aligned in parallel with the axle pipe 15.

OPERATION

MASSAGE OPERATION THROUGH SHAKING MOVEMENT ONLY

As soon as the motor 11 is activated to rotate, the rotating movement produced by the motor 11 is transmitted to the axle pipe 15 via the above-mentioned three-stage planetary gear mechanism 13, which is used for reducing the rotating speed. Each of the kneading rollers 65, 67 is conducted to make shaking and rotating movements simultaneously as the axle pipe 15 begins to rotate. However, rotating movements are prevented by the slide-guiding mechanism 77, and only shaking movements are performed.

Namely, while the axle pipe 15 is rotating, locations of the outer retainers 71 on the axle pipe 15, as it appears on the outside, are shifting towards left and right along the longitudinal axis of the axle pipe 15. The left and right shifting movements of the outer retainers 71 are transmitted to the kneading rollers 65, 67 via the steel balls 75 and the inner retainers 73. Therefore, the gap between the massage-actuating sides (the lower portions) of the kneading rollers 65, 67 broadens and narrows in the left-right direction. As a result, shaking movements of the kneading rollers 65, 67 can be acquired and this performs massage action.

Under this circumstance, the kneading rollers 65, 67 are dragged by the steel balls 75 and have a tendency to rotate. However, rotation of the kneading rollers 65, 67 is prevented because each of the plate-shaped slide guides 81 is inserting into a guide groove 79 formed in the respective kneading roller 65, 67. Also, each of the kneading rollers 65, 67, while shaking, is conducted by a plate-shaped slide guides 81 to perform sliding movement along the longitudinal axis of the axle pipe 15 so that shaking movement of the kneading rollers 65, 67 is possible. Furthermore, the plate-shaped slide guides 81 are long enough to allow the extending and shrinking of the axle pipe 15 (will be described hereinafter).

SPEED-REDUCTION OPERATION

Speed reduction through the three-stage planetary gear mechanism 13 is performed as follows.

Namely, the first planet gear 21 orbits slowly and reduces the rotational speed once as the first sun gear 19, which is coupled with the output axis 17 of the motor 11, rotates. Then, when the second sun gear 25 coupled with the first planet gear 21 is conducted to rotate, the second planet gear 27 orbits more slowly and reduces the rotational speed the second time. And when the third sun gear 31 coupled with the second planet gear 27 is conducted to rotate, the third planet gear 33 orbits even much more slowly and reduces the rotational speed the third time. Finally, the axle pipe 15 coupled with the third planet gear 33 is conducted to rotate. As a result, the axle pipe 15 rotates with a large torque through the above reduction process.

KNEADING-WIDTH ALTERATION OPERATION

If the portion of the fourth manually operated gear 61 extending through the window 63 is manually rotated; then the rotation power is transmitted to the threaded rod 41 via the third manually operated gear 59, the second manually operated gear 57, and the first manually operated gear 55. Through the manual operation, the feed nut 43 coupled with the threaded rod 41 shifts along the longitudinal axis of the threaded rod 41. The axle pipe 15 is then capable of being extended or shortened depending on the outer pipe 15*b*, which is engaged with the feed nut 43 and is capable of shifting with respective to the inner pipe 15*a* along the longitudinal axis of the axle pipe 15. By this arrangement, the gap between the kneading rollers 65, 67 respectively installed on the inner pipe 15*a* and the outer pipe 15*b* can be altered, and the kneading width of the massage operation is thus adjustable.

OTHER EMBODIMENTS

In the slide-guiding mechanism 77 of the above embodiment, the plate-shaped slide guides 81 are inserting into corresponding guide grooves 79 formed in the kneading rollers 65, 67. Other appropriate slide-guiding mechanisms can also be adapted. For example, it is possible to form crescent-shaped guide protrusions in the kneading roller 65, 67 and slit-shaped guide recesses in the housing of the massage machine. The crescent-shaped guide protrusions and the slit-shaped guide recesses are disposed parallel to the longitudinal axis of the axle pipe, and the crescent-shaped guide protrusions are inserting into the matching slit-shaped guide recesses.

Furthermore, steel balls 75 are provided in the installation mechanism for installing the kneading rollers 65, 67 of the above embodiment. Other appropriate installation mechanisms can also be adapted accordingly. For example, it is possible to form ring-shaped grooves or ribs along the outer peripheral wall of the axle pipe 15 and to form corresponding ring-shaped ribs or grooves along the inner peripheral wall of each of the kneading rollers 65, 67. The ring-shaped ribs or grooves of the axle pipe 15 are then to be engaged with the corresponding ring-shaped grooves or ribs of the kneading rollers 65, 67. The material constructing the ring-shaped ribs or grooves can be those that have small sliding-friction coefficients.

As described above, according to this invention, a pair of kneading rollers are installed onto the rotation axle in a manner capable of rotating around the rotation axle freely in substantial circumference direction only. In addition, rotation of the kneading rollers is prevented by the slide-guiding mechanism. As a result, only shaking movement performs massage operation. In this case, only the massage-actuating sides of the kneading rollers that are installed on the rotation axle in an eccentric manner protrude outwardly. Also, it is possible to shape the non-massage-actuating sides of the kneading rollers into non-protruding portions. Namely, in the non-massage-actuating sides, the space required for rotating of the kneading rollers can be entirely omitted. Thus, the whole massage machine can be made compact.

Furthermore, according to this invention, the slide-guiding mechanism includes a guide groove formed in a circumferential portion on the non-massage-actuating side of each of the kneading rollers, and a side guide disposed along the longitudinal direction of the rotation axle engages with each of the guide grooves. Therefore, the slide-guiding mechanism is of simple structure and the cost of the massage machine can thus be reduced.

Furthermore, according to the present invention, the installation mechanism comprises outer retainers disposed along the outer circumferential surface of the rotation axle, inner retainers disposed along the inner circumference surfaces of the kneading rollers, and steel balls retained by and in between the outer retainer and the inner retainer. Therefore, the installation mechanism is of simple structure and the cost of the massage machine can thus be reduced.

What is claimed is:

1. A massage machine comprising:

a rotation axle;

a pair of kneading rollers disposed on the rotation axle in an oblique fashion;

a pair of installation mechanisms, disposed on the rotation axle, for installing the kneading rollers on the rotation axle in a manner that the kneading rollers swing in a circumference direction of the installation mechanisms during the rotation of the rotation axle; and a slide-guide mechanism, engaging with the kneading rollers, for preventing the kneading rollers from rotating during the rotation of the rotation axle, wherein each of the kneading rollers is provided with a guide groove, and the slide-guiding mechanism is provided with a plurality of slide guides, each of which corresponds to the guide groove.

2. The massage machine as claimed in claim 1, wherein each of the installation mechanisms comprises:

an outer retainer disposed on the rotation axle;

an inner retainer disposed in the kneading roller; and a plurality of steel balls retained between the outer retainer and the inner retainer.

3. A massage machine comprising:

a rotation axle;

a pair of kneading rollers disposed on the rotation axle in an oblique fashion;

a pair of installation mechanisms, disposed on the rotation axle, for installing the kneading rollers on the rotation axle in a manner that the kneading rollers swing in a circumference direction of the installation mechanisms during the rotation of the rotation axle; and a slide-guide mechanism, engaging with the kneading rollers, for preventing the kneading rollers from rotating during the rotation of the rotation axle, wherein each of the installation mechanisms comprises:

an outer retainer disposed on the rotation axle;

an inner retainer disposed in the kneading roller; and a plurality of steel balls retained between the outer retainer and the inner retainer.

* * * * *